US006588033B1

(12) United States Patent
Welsh, Jr. et al.

(10) Patent No.: US 6,588,033 B1
(45) Date of Patent: Jul. 8, 2003

(54) FOLDABLE BASSINET WITH SUSPENDED FLOOR HINGE

(75) Inventors: Thomas J. Welsh, Jr., Aurora, IL (US); Peter J. Myers, Wheaton, IL (US)

(73) Assignee: Kolcraft Enterprises, Inc., Chicago, IL (US)

( * ) Notice: Subject to any disclaimer, the term of this patent is extended or adjusted under 35 U.S.C. 154(b) by 0 days.

(21) Appl. No.: 09/563,139

(22) Filed: May 2, 2000

(51) Int. Cl.[7] ..... A47C 29/00
(52) U.S. Cl. ..... 5/99.1; 5/93.1; 5/98.1
(58) Field of Search ..... 5/93.1, 98.1, 99.1, 5/96, 97, 98.3, 102

(56) References Cited

U.S. PATENT DOCUMENTS

| | | | | |
|---|---|---|---|---|
| 243,573 | A | | 6/1881 | Jones |
| 520,699 | A | | 5/1894 | Neal |
| 540,863 | A | | 6/1895 | Lawson |
| 962,587 | A | | 6/1910 | Raettig |
| 1,211,730 | A | * | 1/1917 | Lucas ..... 5/99.1 |
| 1,230,736 | A | | 6/1917 | Lowy et al. |
| 1,234,798 | A | | 7/1917 | Pearce |
| 1,390,630 | A | | 9/1921 | McCord |
| 1,526,038 | A | | 2/1925 | Allman |
| 1,574,226 | A | | 2/1926 | Ackermann |
| 1,630,941 | A | | 5/1927 | Hood |
| 1,782,217 | A | | 11/1930 | Stoddard |
| 1,975,332 | A | | 10/1934 | Rehkopf |
| 2,486,054 | A | | 10/1949 | Morse |
| 2,486,067 | A | | 10/1949 | Schroeder |
| D158,030 | S | | 4/1950 | Wagner |
| 2,553,087 | A | | 5/1951 | Hanson |
| 2,561,037 | A | | 7/1951 | Rex |
| 2,569,937 | A | | 10/1951 | Lindgren |
| 2,574,079 | A | | 11/1951 | White |
| 2,583,187 | A | | 1/1952 | Newbern |
| 2,617,999 | A | | 11/1952 | Mitchell |

(List continued on next page.)

OTHER PUBLICATIONS

"*Evenflo*" playard with bassinet attachment.
"*Graco*" playard with bassinet attachment.

*Primary Examiner*—Lynne H. Browne
*Assistant Examiner*—Fredrick Conley
(74) *Attorney, Agent, or Firm*—Marshall, Gerstein & Borun

(57) ABSTRACT

A foldable bassinet is disclosed. The bassinet can be transformed from an erected position wherein a floor of the bassinet is substantially horizontal to ground, and elevated therefrom by a stand, to a folded position wherein the bassinet is compacted into a relatively small size. Using a uni-directional hinge in the floor of the bassinet, and a plurality of over-center locks, the floor of the bassinet can be locked into the horizontal position easily and effectively, without any structure provided directly below the center of the bassinet floor.

18 Claims, 7 Drawing Sheets

U.S. PATENT DOCUMENTS 2,624,054 A 1/1953 Plant
2,659,903 A 11/1953 Hagelfeldt
2,669,731 A 2/1954 Martin
2,672,627 A * 3/1954 Hagelfeldt ..... 5/99.1
2,688,997 A 9/1954 Miller
2,698,443 A 1/1955 Ralick
2,710,976 A 6/1955 Martensen
2,790,978 A 5/1957 Tigrett
2,793,374 A 5/1957 Doud
2,823,390 A 2/1958 Hagelfeldt
2,873,458 A 2/1959 Adamson
D186,358 S 10/1959 Fulton
2,908,021 A 10/1959 Fulton
2,922,169 A 1/1960 Werner
2,942,750 A 6/1960 Neely
2,974,325 A * 3/1961 Mango ..... 5/94
2,992,440 A 7/1961 Revolt
2,992,441 A 7/1961 Landry
RE25,195 E 7/1962 Hamilton
3,063,065 A 11/1962 Shaw
3,064,277 A 11/1962 Gill
3,092,847 A 6/1963 De Puy
3,095,583 A 7/1963 Golub et al.
3,103,670 A 9/1963 Landry
3,146,736 A * 9/1964 Hetrick ..... 108/115
3,158,876 A 12/1964 Gottlieb
3,183,528 A 5/1965 Jacobs et al.
3,206,773 A * 9/1965 Sarasin ..... 5/99.1
3,233,254 A 2/1966 Golub et al.
3,296,633 A 1/1967 Rieger
3,309,718 A 3/1967 Sarasin
3,430,273 A 3/1969 Stillwaugh
3,474,472 A 10/1969 Hamilton, II
3,546,721 A 12/1970 Cleary
3,574,872 A 4/1971 Mattila
3,699,594 A 10/1972 Matthey-Doret
3,732,860 A 5/1973 Thurmer
3,735,430 A 5/1973 Platz
3,789,439 A 2/1974 Berg et al.
3,800,341 A 4/1974 Davanzo
4,044,411 A 8/1977 Peterson
4,069,524 A 1/1978 Carlo
4,070,716 A * 1/1978 Satt et al. ..... 5/99.1
4,073,017 A 2/1978 Stevens
D257,299 S 10/1980 Cone
4,455,697 A 6/1984 Rovida
4,483,026 A 11/1984 Kassai
4,499,619 A 2/1985 Kassai
4,561,138 A 12/1985 Hwang
4,573,224 A 3/1986 Saint
4,635,305 A 1/1987 Wyss
4,651,367 A 3/1987 Osher et al.
4,683,600 A 8/1987 Beger
4,688,280 A 8/1987 Kohus et al.
4,692,953 A 9/1987 Fetters
4,739,527 A 4/1988 Kohus et al.
4,750,223 A 6/1988 D'Arcy et al.
4,811,437 A 3/1989 Dillner et al.
4,819,285 A 4/1989 Fetters
D304,523 S 11/1989 Dillner et al.
4,890,346 A 1/1990 Rist
4,921,369 A 5/1990 Chew, II et al.
4,934,025 A 6/1990 Mariol
4,967,432 A 11/1990 Kujawski et al.
4,985,948 A 1/1991 Mariol
4,999,863 A 3/1991 Kane
D316,339 S 4/1991 Taylor
D323,589 S 2/1992 Mariol
5,115,524 A 5/1992 Antosko
5,193,234 A 3/1993 Joaquin
5,197,154 A 3/1993 Shamie
5,211,498 A 5/1993 Huang
5,228,154 A 7/1993 Brevi et al.
5,241,716 A 9/1993 Kohus
5,243,718 A 9/1993 Shamie
5,279,006 A 1/1994 Teng
5,293,656 A 3/1994 Chan
5,339,470 A 8/1994 Shamie
5,349,709 A 9/1994 Cheng
5,353,451 A 10/1994 Hsiung
5,358,220 A 10/1994 Yu-Kuang
5,363,521 A 11/1994 Garland et al.
5,367,725 A 11/1994 Tsai
5,377,368 A 1/1995 Cheng
5,381,570 A 1/1995 Cheng
5,446,931 A 9/1995 Wei
5,504,951 A 4/1996 Yeh
5,542,134 A 8/1996 Wang
5,544,864 A 8/1996 Gabriel-Lacki et al.
5,553,336 A 9/1996 Mariol
5,560,055 A 10/1996 Ziegler
5,581,827 A 12/1996 Fong et al.
5,615,427 A 4/1997 Huang
5,664,267 A 9/1997 Cheng
5,745,954 A 5/1998 Shogan et al.
5,778,465 A 7/1998 Myers
5,781,944 A 7/1998 Huang
5,857,229 A 1/1999 Magnani, Jr.
5,867,850 A 2/1999 Mariol
5,867,851 A 2/1999 Mariol et al.
D407,914 S 4/1999 Mariol et al.
D407,915 S 4/1999 Mariol et al.
5,904,344 A 5/1999 Pope et al.

* cited by examiner

FOLDABLE BASSINET WITH SUSPENDED FLOOR HINGE

FIELD OF THE INVENTION

The present invention generally relates to cribs and bassinets and, more particularly, relates to portable and foldable cribs and bassinets.

BACKGROUND OF THE INVENTION

Bassinets have been used in the care of infants for centuries. Such devices typically include an oblong-shaped basket having a floor, raised walls, and an open top. A mattress and/or other suitable cushioning are typically provided within the basket for enhancing the comfort of the child. The basket is often provided on some form of stand to elevate the level of the basket for ease of use.

As families have become increasingly mobile, it has become increasingly desirable to provide a portable bassinet to accommodate this mobility. However, given the shape of the oblong basket, height of the supporting stand, and structural integrity and weight limitations required of such devices, bassinets do not easily lend themselves to transformation into dimensionally small and light weight units for ease of transportation and/or storage.

A number of foldable playpens and cribs have been created. However, to the extent such structures include a foldable floor, they typically rely on support afforded by the ground on which they rest to maintain a horizontal floor position. If elevated, the ground would provide no support, and the floor would tend to invert given a sufficiently heavy load. Alternatively, centralized support structure must be provided below the foldable floor. Such structure necessarily imposes undesirable size and weight penalties on the device.

SUMMARY OF THE INVENTION

In accordance with one aspect of the invention, a bassinet is provided which comprises a frame, a floor, and a flexible sidewall. The frame includes a top member with first and second legs and first and second rims pivotally attached thereto. The frame is foldable from an erected position wherein the rims are parallel to the top member to a folded position wherein the rims are non-parallel to the top member. The floor supported below the rims includes first and second halves connected by a hinge. The first and second halves are foldable downwardly about the hinge, but the hinge prevents folding of the first and second halves upwardly about the hinge. The flexible sidewall connects the first and second floor halves to the first and second rims, respectively. The first and second rims and the sidewalls prevent the first and second halves of the floor from being downwardly folded about the hinge when the frame is in the erected position.

In accordance with another aspect of the invention, a bassinet is provided which comprises a frame, and a foldable floor. The foldable floor is supported by the frame and connected by a center hinge. The center hinge is suspended without any structure directly therebelow.

In accordance with another aspect of the invention, a bassinet is provided which comprises a top member, first and second legs pivotally attached to the top member, first and second rims pivotally attached to the top member, first and second tension bars connecting the first leg to the first rim and the second leg to the second rim, respectively, a flexible wall extending downwardly from the first and second rims, a foldable floor supported in a substantially horizontal plane by the flexible wall below the first and second rims to define a crib space with the flexible wall, and a hinge connecting first and second halves of the foldable floor. The hinge also prevents upward folding of the floor, while the tension bars, rims, and flexible wall prevent downward folding of the floor.

These and other aspects and features of the invention will become more apparent from the following detailed description when taken in conjunction with the accompanying drawings.

Figure 1:
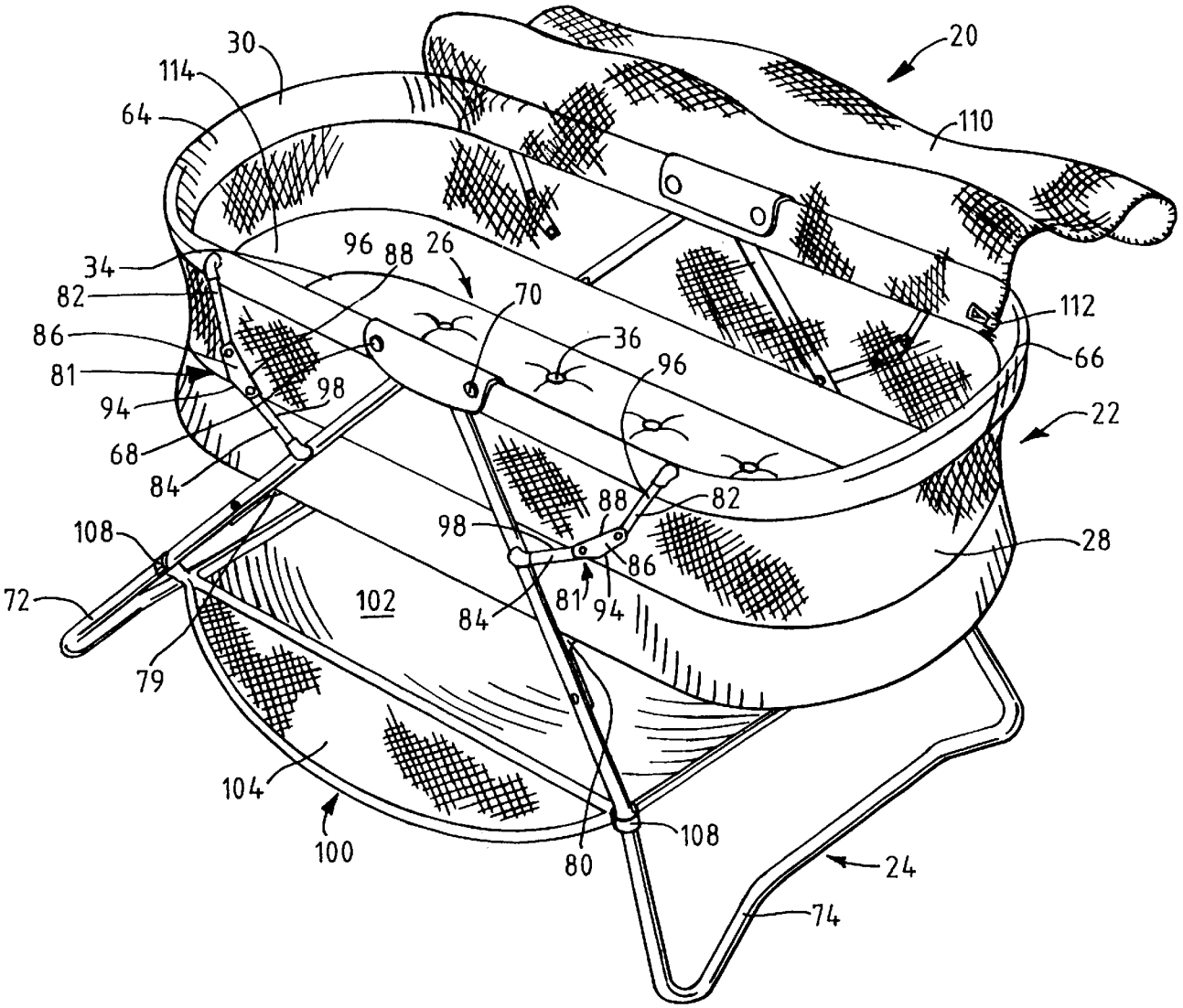
FIG. 1 is an isometric view of a bassinet constructed in accordance with the teachings of the invention.

While the invention is susceptible to various modifications and alternative constructions, certain illustrative embodiments thereof have been shown in the drawings and will be described below in detail. It should be understood, however, that there is no intention to limit the scope of this patent to the specific forms disclosed, but on the contrary, the intention is to cover all modifications, alternative constructions and equivalents falling within the spirit and scope of the appended claims.

DETAILED DESCRIPTION OF THE PREFERRED EMBODIMENTS

Referring now to the drawings, and with particular reference to FIG. 1, a bassinet constructed in accordance with the teachings of the invention is generally depicted by reference numeral 20. As shown therein, the bassinet 20 includes a sleeping basket 22 supported by a foldable stand 24. As will be discussed in further detail herein, the bassinet 20 is foldable from the deployed or erected position shown in FIGS. 1–5, to the stowed or folded position shown in FIG. 6. When in the deployed position, the bassinet 20 provides a stable and sturdy sleeping basket 22, and when in the stowed position, the bassinet 20 forms a compact structure for ease of storage and transportation purposes.

Referring again to FIG. 1, and with additional reference to FIGS. 2–5, the basket 22 is shown having a floor 26.from which a flexible side 28 upwardly extends to define an oblong-shaped enclosure, with an open top 30. The flexible side 28 is depicted as one continuous expanse of material having four identifiable sides, but could be provided in multiple sections without departing from the scope and spirit of the invention.

Figure 3:
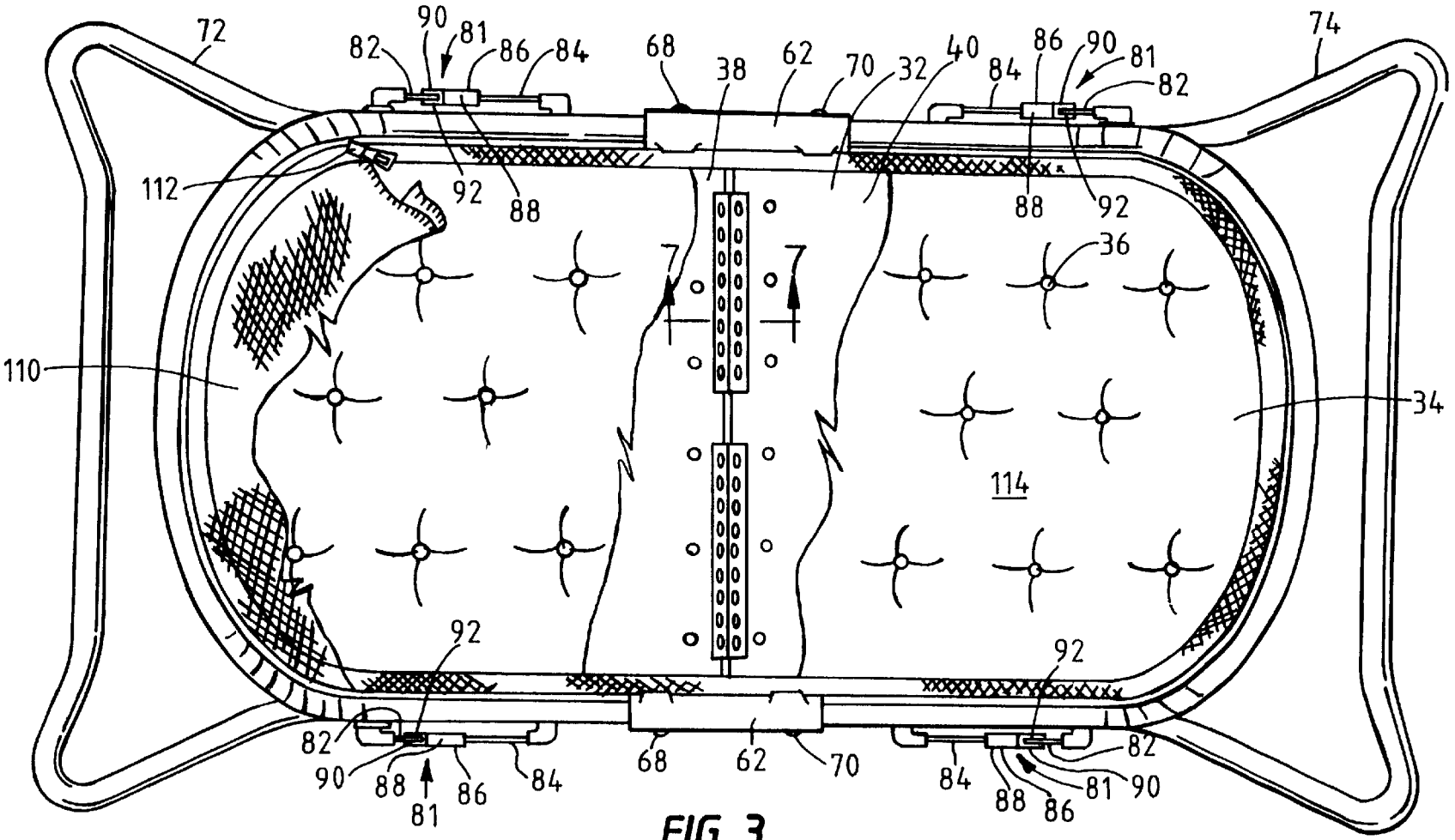
FIG. 3 is a top view of the bassinet shown in FIG. 1, with a mattress therein being partially torn away to show a suspended hinge according to the invention.
Figure 4:
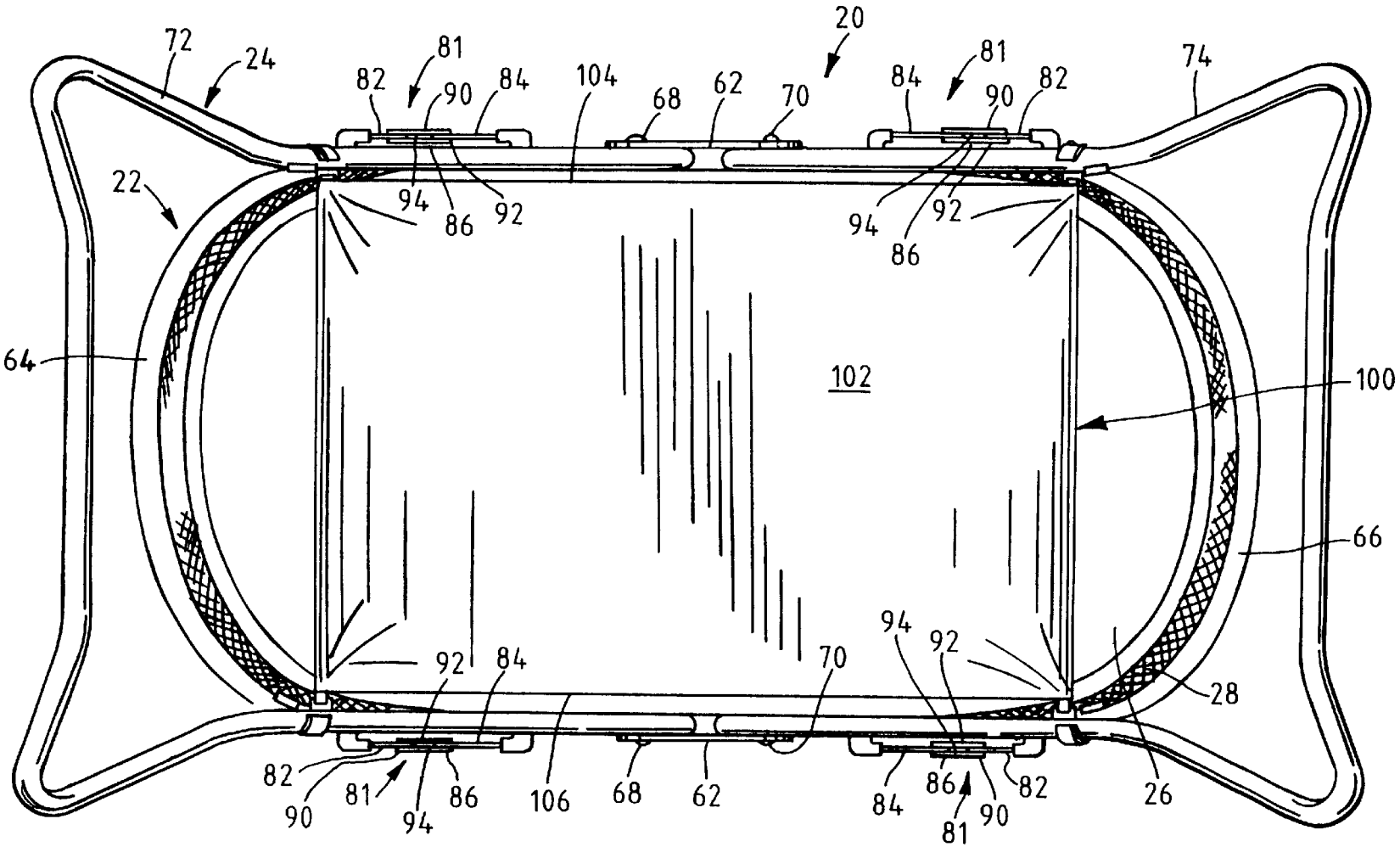
FIG. 4 is a bottom view of the bassinet shown in FIG. 1.
Figure 5:
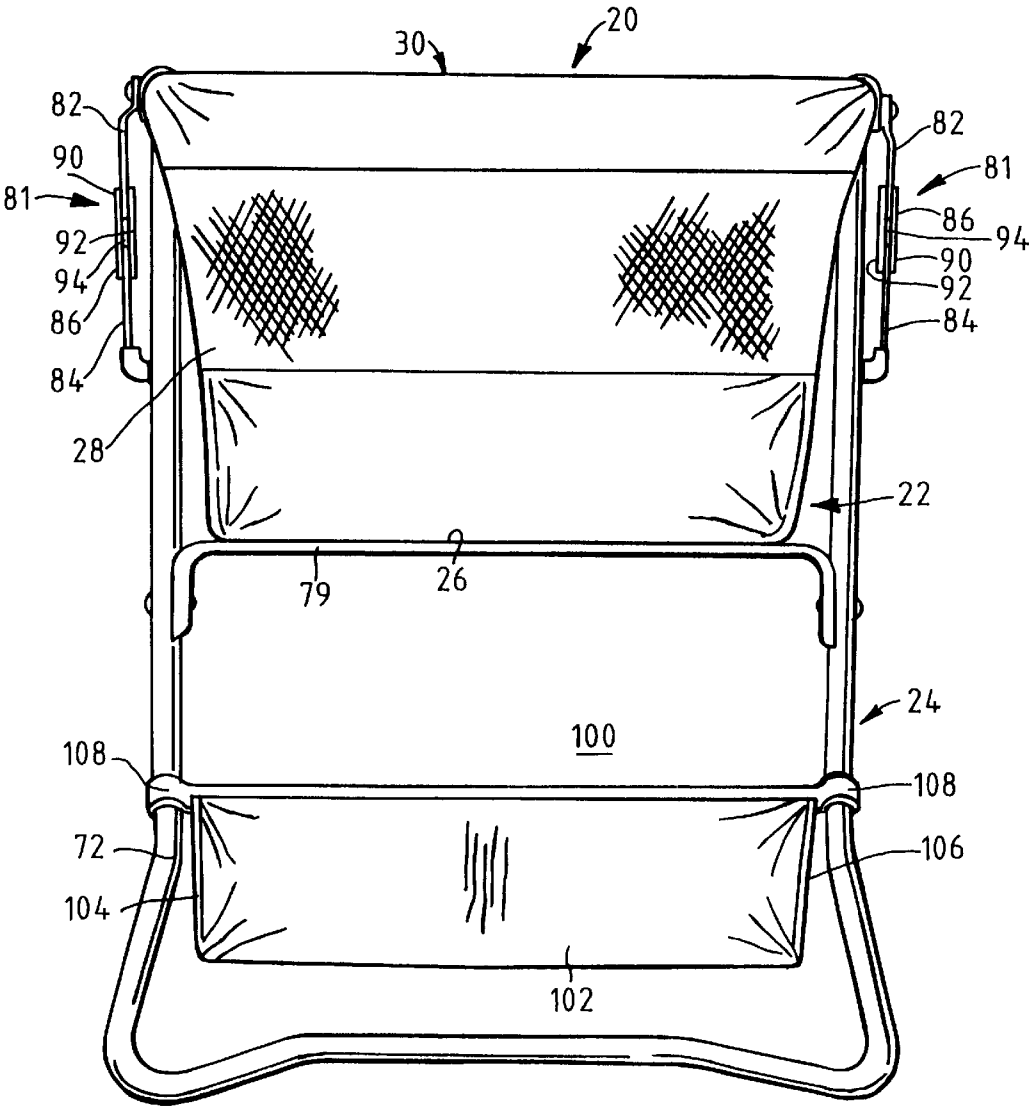
FIG. 5 is an end view of the bassinet shown in FIG. 1.
Figure 7:
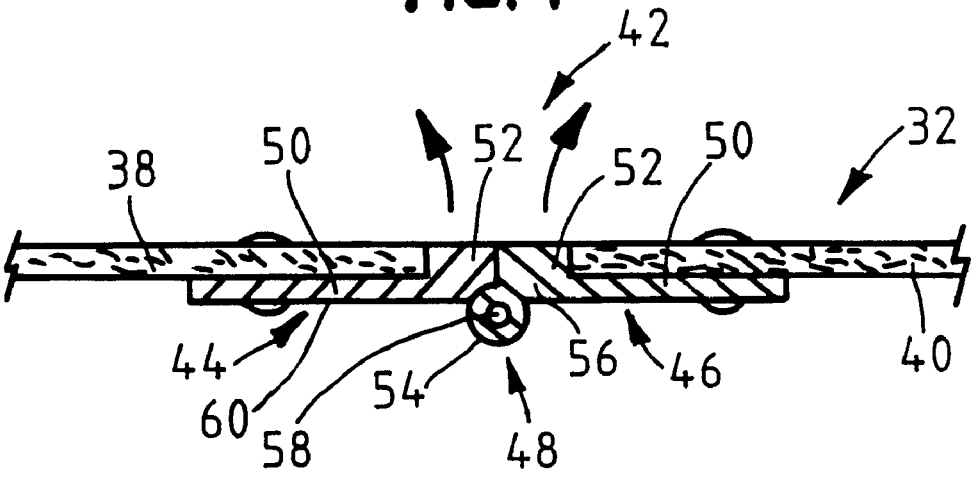
FIG. 7 is a sectional view of the suspended hinge taken along line 7—7 of FIG. 3.
Figure 8:
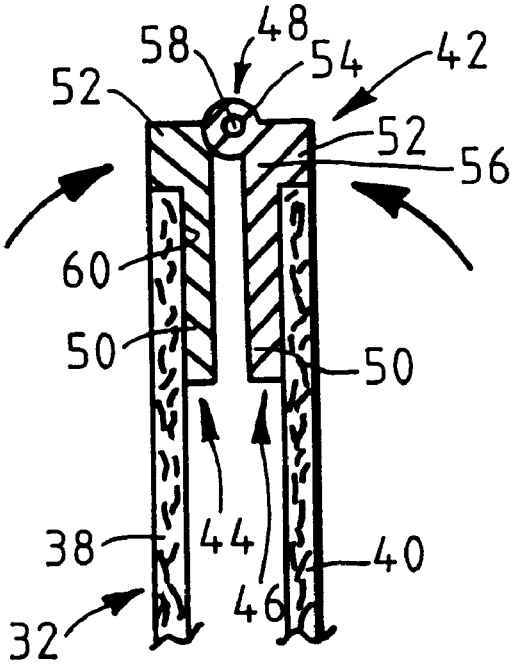
FIG. 8 is a sectional view of the suspended hinge shown in FIG. 7, but showing the hinge in a stowed or folded position.

As shown best in FIGS. 3 and 7–8, the floor 26 includes a hardened sub-floor 32, on which a cushioned mattress material 34 having buttons 36 rests. The sub-floor 32 is provided in first and second halves 38, 40, which are connected by a unidirectional hinge 42. The hinge 42 can be provided in multiple portions, such as the two, laterally spaced, portions depicted.

Each portion of the hinge 42, as shown in detail in FIGS. 7 and 8, includes first and second leaves 44 and 46 connected at a pivot 48. Each leaf 44 and 46 includes an elongated base 50 and a raised ledge 52. The elongated base 50 and raised ledge 52 are provided normal to each other. The second leaf 46 includes a bearing surface 54 at a corner 56 thereof. A pivot rod 58, connected to the first leaf 44, matingly fits within the bearing surface 54 to allow for pivotal motion. As shown in FIGS. 7 and 8, and described in further detail herein, it can be seen that the hinge 42 is able to pivot downwardly about pivot 48 from the deployed position shown in FIG. 7 to the stowed position shown in FIG. 8. However, the contact between the adjacent raised ledges 52, and the location of the pivot 48 on a bottom surface 60 of the hinge 42 prevents the hinge 42 from being pivoted upwardly about the pivot 48, the significance of which will be discussed in further detail herein.

Figure 2:
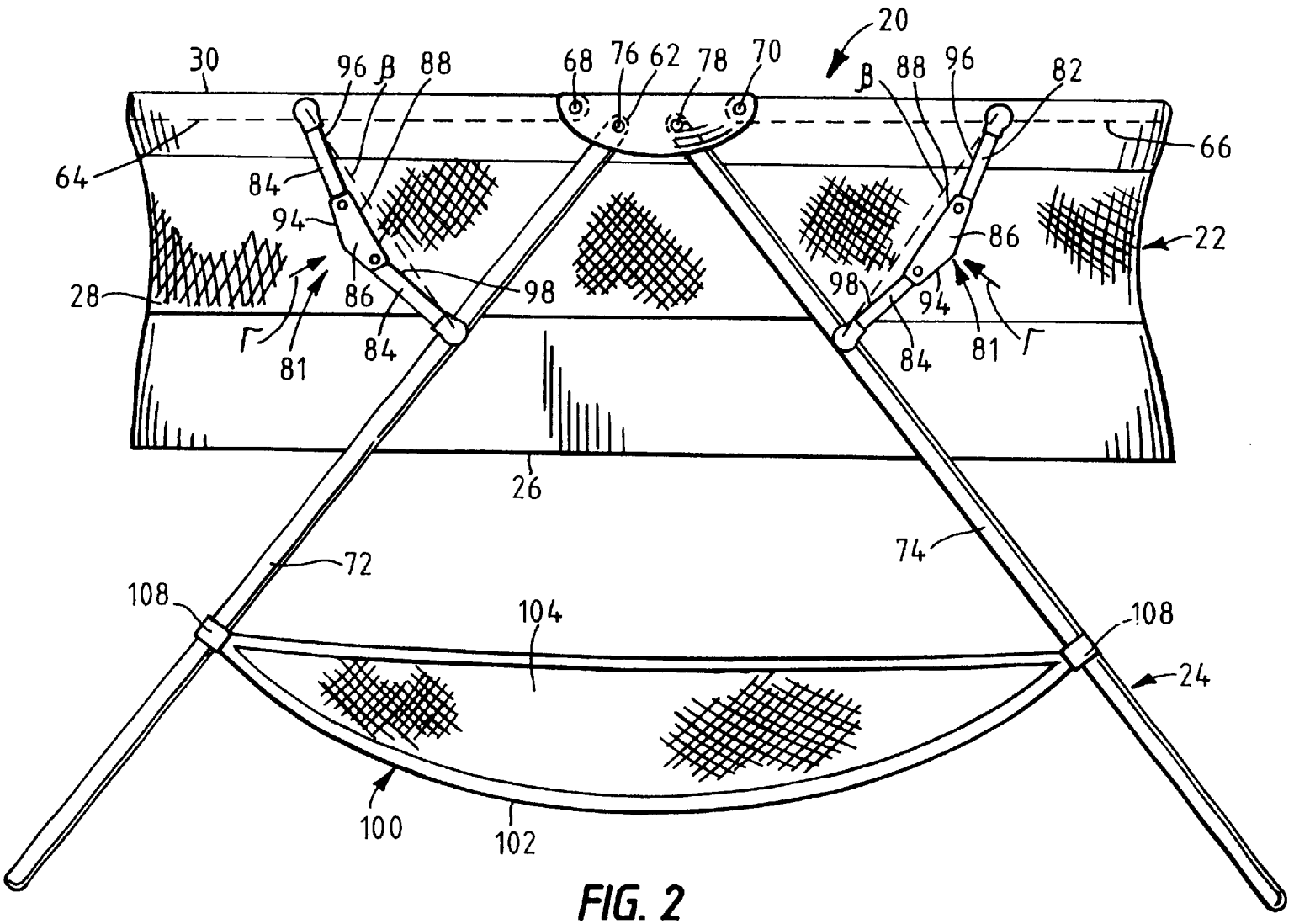
FIG. 2 is a side view of the bassinet shown in FIG. 1.

Referring now to FIG. 2, the illustrated stand 24 has a frame or top member 62 to which first and second rims 64, 66 (shown in phantom) are pivotally attached at pivots 68, 70, respectively. First and second legs 72, 74 are also pivotally attached to the frame 62, at separate pivots 76, 78, respectively (also shown in phantom). Each of the first and second rims 64, 66 and first and second legs 72, 74 are substantially U-shaped in the depicted bassinet 20. However, persons of ordinary skill in the art will appreciate that other shapes are possible, particularly with regard to first and second legs 72, 74, wherein four individual legs could be provided as opposed to the two legs depicted without departing from the scope or spirit of the invention. Supporting cross-bars 79, 80 may laterally span the U-shaped legs 72, 74 to provide added structural support.

Figure 6:
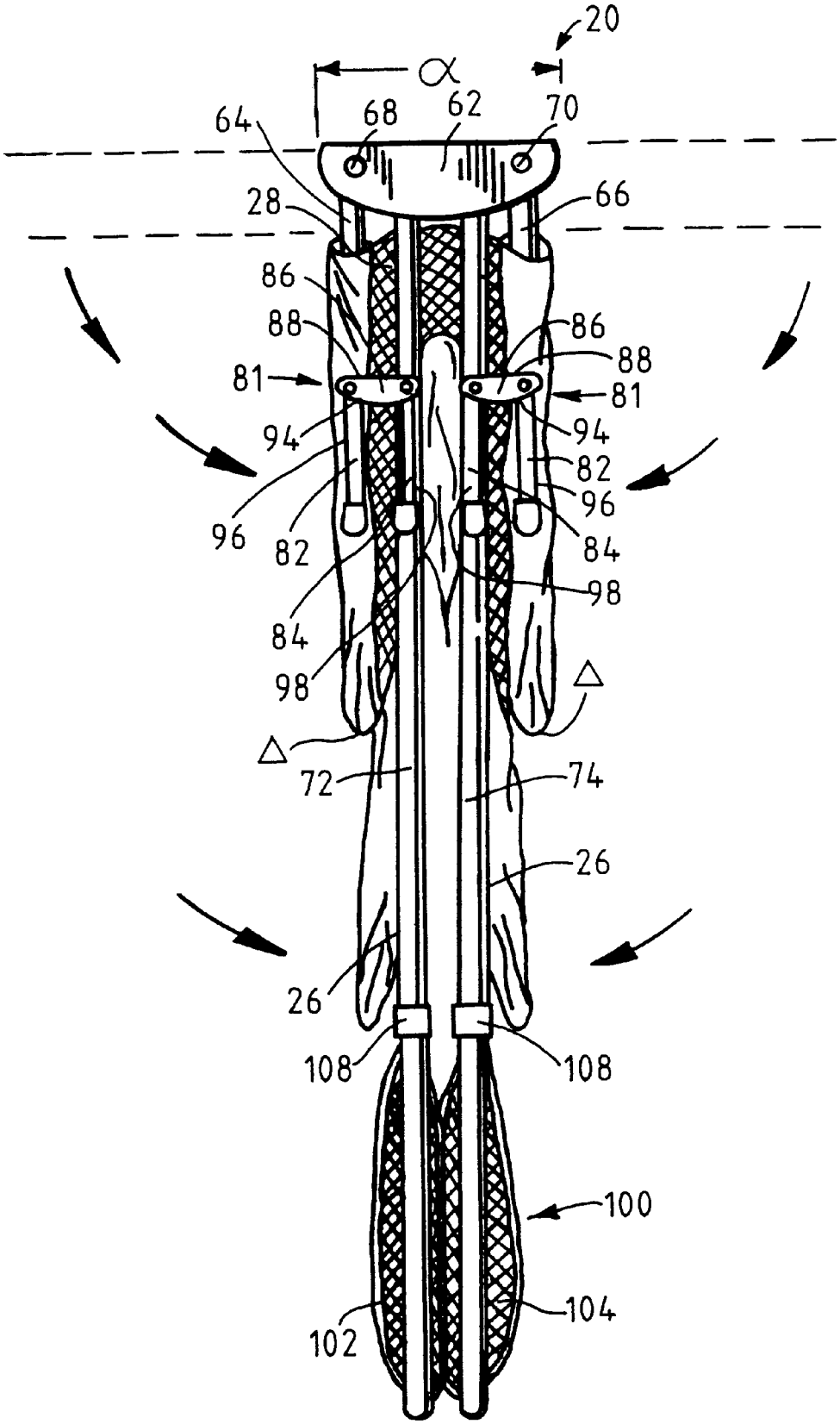
FIG. 6 is a side view of the bassinet shown in FIG. 1, and configured in a stowed or folded position.

When the stand 24 is folded from the deployed position shown in FIGS. 1–5 to the stowed position shown in FIG. 6, each of the first and second rims 64, 66, and first and second legs 72, 74 are substantially parallel to one another with the flexible sidewall 28 being collapsed inwardly. In so doing, the resulting width $\alpha$ of the bassinet 20 is minimized and limited to the relatively short expanse of material provided by the frame 62. Accordingly, in the stowed position, the bassinet 20 can be easily transported and/or stored in multiple areas, including beneath a bed, or within a trunk space, for example.

In order to temporarily lock the stand 24 in the deployed position shown in FIG. 1, and to thereby secure the floor 26 in a horizontal plane, a plurality of tension bars 81 are provided. In the depicted embodiment, four such tension bars 81 are provided, two of which connect the first rim 64 to the first leg 72, and two of which connect the second rim 66 to the second leg 74. Referring specifically to FIG. 2, the tension bars 81 are shown in detail. Each includes first and second links 82, 84, which are pivotally connected to a locking clip 86. As can be seen from FIGS. 3 and 4, each locking clip 86 is channel-shaped and includes a closed side 88 from which first and second lateral sides 90, 92 extend. An open space 94 is provided opposite the closed side 88 and allows the pivot links 82, 84 to pass therethrough. Such tension bars 81 are of a conventional design, common on such devices as foldable card tables and the like, and are often referred to as over-center locks.

The combined length of the first and second links 82, 84 and locking clip 86 is slightly greater than the combined distance depicted by the center line $\beta$ between adjacent rims and legs. Therefore, as the stand 24 is folded from the stowed position of FIG. 6 to the deployed position of FIGS. 1–5, the user must exert substantial force on the locking clip 86 to force the corresponding tension bar past the center line $\beta$. This in turn flexes the rims and legs away from each other to allow for the locking clip 86 to pass over-center. The tension bar 80 is locked in place by engagement of sides 96, 98 of the pivot links 82, 84, respectively, with the closed sides 88 of the locking clips 86. In so doing, the locking clips 86 are prevented from further outward motion slightly past the center line $\beta$, and the stand 24 is temporarily locked into the deployed position. In order to move or transform the stand 24 back into the stowed position the user must exert sufficient force in the direction of arrow $\lceil$ (see FIG. 2) to pivot the tension bars 80 inwardly.

When the tension bars 81 are in the locked positions shown in FIGS. 1–5, the tension generated thereby is transferred through the stand 24 such that the first and second rims 64, 66 are located in planes which are substantially horizontal to ground. Since the flexible sidewall 28 is connected to the first and second rims 64, 66, and to the first and second floor halves 38, 40, this tension is also transferred through the flexible side 28 to the floor 26 to hold the floor horizontal to ground as well. The flexible sidewall 28 is sized to barely stretch between the floor 26 and the first and second rims 64, 66 when in the deployed position to facilitate this tension transfer.

It can therefore be seen that the hinge 42, which prevents upward rotation past horizontal, and the tension bars 38, which prevent downward rotation past horizontal, cooperate to maintain and temporarily lock the floor 26 in a horizontal position when the bassinet 20 is in the deployed position. Such horizontal maintenance is provided without any structure whatsoever being provided directly below the hinge 42, or floor 26, as clearly shown in FIG. 2. Moreover, the hinge 42 cooperates with the floor 26 to provide a continuous, flat bottom surface for the sleeping basket 22, adding to the comfort of the infant when the bassinet 20 is in use.

As accessories to the bassinet 20, a storage basket or bay 100 is provided below the sleeping basket 22. The storage bay 100 is preferably manufactured from fabric to allow for necessary flexibility when moving from the stowed position to the deployed position. The storage bay 100 may include an arcuately shaped bottom 102 with first and second semi-circularly shaped sides 104 and 106. The storage bay 100 may be connected at each of the four resulting corners 108 to the first and second legs 72 and 74.

As shown in FIGS. 1 and 3, a protective upper shield 110 may be provided proximate the first and second rims 64 and 66 and be partially removable therefrom via a suitable fastener, such as a zipper 112. When the upper shield 110 is secured to the first and second rims 64, 66 via the zipper 112, the upper shield 110 is horizontal to the floor 26 and provides an enclosed crib space 114. The protective shield 110 is preferably manufactured from a mesh-like material to allow for communication between the crib space 114 and ambient air. The flexible sidewall 28 is preferably manufactured from a similar mesh material. To secure the flexible sidewall 28 to the first and second rims 64, 66 and the floor 26, a solid fabric material may be employed.

In operation, it can therefore be seen that the bassinet 20 can be easily transformed from the stowed position, shown in FIG. 6, to the deployed position, shown in FIG. 2, with limited effort by the user. More specifically, starting with FIG. 6, a user can simply pull upwardly and outwardly upon the first and second rims 64, 66 at points $\Delta$. This motion in turn pulls the first and second rims 66, 64 into a horizontal position parallel with the frame 62. Since the first and second rims 64, 66 are attached to the tension bars 81, which in turn are connected to the first and second legs 72, 74, the tension bars straighten and the legs are pulled apart to the position shown in FIG. 2. If sufficient force is generated by such motion, the locking clips 86 may pass over-center and into the locked position. Alternatively, once the stand 26 is in the deployed position, the user may need to apply additional force to the locking clips 86 to pass the clips 86 over-center and lock the bassinet 20 into the deployed position.

When the bassinet 20 is to be placed back into the stowed position of FIG. 6, the user simply needs to apply sufficient force to the locking clips 86 in the opposite direction, which in turn collapses the first and second rims 64, 66 downwardly and enables the first and second legs 72, 74 to be folded inwardly into the parallel configuration of FIG. 6. The bassinet 20 can then be grasped, as by the frame 62, or by the first and second legs 72, 74 for easy transportation and storage purposes.

From the foregoing, it can be seen that the disclosed bassinet can be easily transformed from a sturdy deployed position to a compact stowed position. In the deployed position, substantial structure is provided to ensure the bassinet is secured and stable, yet no structure is provided directly below the center of the bassinet floor. In the stowed position, the illustrated bassinet occupies little space and is easily transported. Moreover, through such a design, the disclosed unit can be easily manufactured at relatively low cost and weight.

What is claimed is:

1. A bassinet, comprising:

a frame having a top member with first and second legs and first and second rims pivotally attached thereto, the frame being foldable from an erected position wherein the rims are parallel to the top member, to a folded position wherein the rims are non-parallel to the top member;

a floor supported below the rims, the floor including first and second halves connected by a hinge, the first and second halves being foldable downwardly about the hinge, the hinge preventing folding of the first and second halves upwardly about the hinge; and a flexible sidewall connecting the first and second floor halves to the first and second rims, respectively, the first and second rims and flexible sidewall preventing the first and second halves from folding downwardly about the hinge when the frame is in the erected position;

the hinge including first and second leaves connected at a pivot, the first and second leaves each being substantially L-shaped in cross section and including a corner, the pivot being provided at the corner of each leaf.

2. The bassinet of claim 1 wherein no supporting structure is provided directly beneath the floor.

3. The bassinet of claim 1 wherein the hinge is suspended without supporting structure directly beneath the hinge.

4. The bassinet of claim 1 further including a first tension bar extending between the first rim and first leg, and a second tension bar extending between the second rim and the second leg.

5. The bassinet of claim 4 wherein the first and second tension bars include over-center locks.

6. The bassinet of claim 5 wherein the tension created in the frame by the first and second tension bars is transferred through the flexible sidewall to the floor to maintain the floor in a horizontal position when the frame is in the erected position.

7. The bassinet of claim 6 wherein the flexible side wall is made of a mesh material.

8. The bassinet of claim 1 wherein the first and second legs and first and second rims are foldable into a parallel configuration when the frame is in the folded position.

9. The bassinet of claim 1 further including a storage basket suspended between the legs below the floor.

10. The bassinet of claim 1 further including a removable protective shield coupled to the first rim and the second rim.

11. A bassinet, comprising:

a frame; and a foldable floor supported by the frame and connected by a center hinge, the center hinge including first and second leaves connected by a pivot, the first and second leaves each including an inner edge, the inner edges being adjacent one another when the foldable floors are horizontal, the pivot being provided on one side of the hinge proximate the inner edges;

wherein the foldable floor is suspended without any structure supporting it from below.

12. The bassinet of claim 11 wherein the frame is foldable from a deployed position to a space-saving stowed position.

13. The bassinet of claim 11 wherein the frame includes a top member to which first and second U-shaped legs and first and second U-shaped rims are pivotally connected.

14. The bassinet of claim 11 wherein the center hinge is adapted to pivot in only a single direction.

15. The bassinet of claim 13 wherein the frame is lockable in the deployed position by a first tension bar extending between the first leg and first rim and a second tension bar between the second leg and the second rim.

16. The bassinet of claim 15 wherein the first and second tension bars each include first and second legs pivotally attached to a locking clip, the locking clip having a base and first and second opposed sides, the first and second legs being pivotally attached to the first and second sides, the base preventing rotation of the first and second legs in one direction.

17. The bassinet of claim 15 further including flexible sides connecting the foldable floor to the frame.

18. The bassinet of claim 17 wherein tension generated by the first and second tension bars is transferred through the frame and flexible sides to lock the floor in a horizontal configuration in cooperation with the center hinge.

* * * * *